US006600267B1

(12) United States Patent
Dotterweich et al.

(10) Patent No.: US 6,600,267 B1
(45) Date of Patent: Jul. 29, 2003

(54) HIGH PRESSURE DISCHARGE LAMP HAVING CAP TO PREVENT FLASHOVER

(75) Inventors: Ralf Dotterweich, Berlin (DE); Clemens Wesseling, Berlin (DE)

(73) Assignee: Patent-Treuhand-Gesellschaft fuer Eleltrische Gluehlampen mbH, Munich (DE)

( * ) Notice: Subject to any disclaimer, the term of this patent is extended or adjusted under 35 U.S.C. 154(b) by 0 days.

(21) Appl. No.: 09/831,521

(22) PCT Filed: Apr. 8, 2000

(86) PCT No.: PCT/DE00/01090

§ 371 (c)(1),
(2), (4) Date: May 10, 2001

(87) PCT Pub. No.: WO01/24222

PCT Pub. Date: Apr. 5, 2001

(30) Foreign Application Priority Data

Sep. 30, 1999 (DE) ..... 199 47 242

(51) Int. Cl.[7] ..... H01J 17/04; H01J 61/04

(52) U.S. Cl. ..... 313/624; 313/623; 313/318.07; 313/625

(58) Field of Search ..... 313/623, 624, 313/625, 626, 25, 317, 318.07

(56) References Cited

U.S. PATENT DOCUMENTS

| | | | | | |
|---|---|---|---|---|---|
| 3,804,045 | A | | 4/1974 | Banks, Jr. | 113/120 H |
| 4,254,355 | A | * | 3/1981 | Taylor | 313/625 |
| 4,629,929 | A | * | 12/1986 | Saito et al. | 313/25 |
| 5,159,242 | A | * | 10/1992 | Ravi | 313/25 |

FOREIGN PATENT DOCUMENTS

| | | | | |
|---|---|---|---|---|
| EP | 0 517 304 | | 9/1992 | |
| EP | 921553 | A2 * | 6/1999 | H01J/5/48 |

OTHER PUBLICATIONS

Patent Abstracts of Japan, vol. 017, No. 473 (E–1423), Aug. 27, 1993, & JP 05 114386 A (WAKOMU:KK), May 7, 1993, abstract; figure 2.

Patent Abstracts of Japan, vol. 018, No. 403 (E–1584), Jul. 27, 1994 & JP 06 119909 A (ETOU DENKI KK), Apr. 28, 1994, abstract & WPI Abstract.

* cited by examiner

*Primary Examiner*—Ashok Patel
*Assistant Examiner*—Mariceli Santiago
(74) *Attorney, Agent, or Firm*—Carlo S. Bessone

(57) ABSTRACT

A high-pressure discharge lamp having a discharge vessel (1) closed at two ends, the supply lead (15) near the base, and the free end (14) of the associated short supply conductor (4) being covered by a tubular cap (10) whose first end, directed toward the discharge vessel, is open, and whose second end, directed toward the base, is closed.

10 Claims, 5 Drawing Sheets

HIGH PRESSURE DISCHARGE LAMP HAVING CAP TO PREVENT FLASHOVER

TECHNICAL FIELD

The invention proceeds from a high-pressure discharge lamp in accordance with the preamble of claim 1. It concerns, in particular, metal halide lamps with outer bulbs which have a base at one end. The invention is also, however, suitable for application in the case of sodium or mercury high-pressure discharge lamps.

PRIOR ART

EP-A 517 304 has already disclosed a high-pressure discharge lamp in which a discharge vessel closed at two ends is held in an outer bulb by means of a frame. In this case, both the supply lead near the base and the electric supply conductor remote from the base are sheathed by an insulating covering made from quartz glass, in order to avoid flashovers during hot restarting. Because it is assumed that a flashover chiefly takes place between these two conductors, their effective spacing is lengthened by virtue of the fact that the supply lead near the base is sheathed from its exit from the shaft of the discharge vessel virtually up to the crossing point with the associated electric supply conductor near the base. The flashover length is thereby increased.

However, it emerges in practice that the problem to be solved is more complex, since a flashover is possible between all the electrically conducting components in the outer bulb. An attempt is therefore made in general to prevent flashovers by a large spacing between oppositely polarized current-conducting components, by the avoidance of small radii of curvature and sharp bends in the conducting components, and by the use of glass tubes open at both ends, over the outer supply leads. Finally, this requires therefore relatively large volumes in the outer bulb in order to keep the spacings sufficiently large.

SUMMARY OF THE INVENTION

It is the object of the present invention to provide a high-pressure discharge lamp in accordance with the preamble of claim 1, whose capacity for hot starting is improved. This holds, in particular, for lamps of high power above 1 kW.

This object is achieved by means of the characterizing features of claim 1. Particularly advantageous refinements are to be found in the dependent claims.

In detail, the aim above all is to improve the hot-starting capacity of metal halide lamps, with a base at one end, having outer bulbs and a high electric power of preferably 4 kW to 12 kW. The lamps comprise an outer bulb having a base which is at one end and in which there is arranged a discharge vessel closed at two ends and lying on the lamp axis. It is closed by means of two sealing means, in particular seals or pinches. Immediately after the lamp is switched off, gaseous mercury and gaseous metal halides are present in the discharge vessel. These filling components bind free charge carriers. The high-voltage pulse supplied by the starting device leads in this state without special countermeasures to a discharge in the outer bulb instead of to a discharge between the electrodes in the discharge vessel. This occurs between differently polarized conductors, in particular between the two outer supply conductors, between an outer supply conductor and a lower fail system, sealed approximately at the end of the outer bulb, in a pinch, or between the supply conductor remote from the base and the opposite supply lead near the base. The fact is particularly pronounced 3 to 6 minutes after the lamp has been switched off.

A further mechanism has surprisingly proved to be disturbing, specifically a creeping discharge which forms between the free end of the supply conductor near the base and the insulating covering on the supply conductor remote from the base. The creeping discharge migrates from the covering as far as the supply conductor remote from the base itself, such that a flashover can thereby occur.

According to the invention, the free end of the supply conductor near the base is covered with respect to the covering by a cap. The cap is a hollow cylindrical one. It can be adapted in shape to the sealing part, that is to say be tubular in the case of a seal, and rectangular in cross section in the case of a pinch. The cap is open at least at the first end, which faces the discharge vessel. It is preferably closed at the second end, facing the base, particularly whenever the outer bulb is closed by means of a Moly-Cup seal, or else by means of a pinch with foils. Flashovers toward these metal parts are thereby avoided.

The free end of the supply conductor near the base is advantageously angled away transverse to the lamp axis, because then it is possible to ensure a good connection by welding or soldering to the supply conductor near the base. The cap is advantageously then slotted on one side and formed as a tube, in particular as a glass tube made from quartz glass.

The outer bulb is preferably evacuated or filled with nitrogen. A typical value for the nitrogen filling pressure (cold) is 400 to 1400 mbar, in particular 800 mbar to 950 mbar.

Overall, flashovers of any type are reliably avoided between electrically conducting, differently polarized components, and the desired flashover in the discharge vessel is thereby ensured. By comparison with the prior art, the cap permits a more compact design and a greater freedom in the construction of the lamp.

Lamps of compact design are possible because of the cap. It is already advantageously sufficient for the breakdown strength when the length of the part projecting from the discharge vessel, of the supply lead near the base to be at most six times (preferably at most three times) the diameter of the supply conductor near the base. This length or this ratio can therefore be kept extremely short/small by comparison with the prior art.

It is possible to dispense with a pinch with a foil seal as a closure technique for the outer bulb. Instead of this, use can also be made of a so-called Moly-Cup seal (see below). In this case, a cap closed at one end is preferred for the purpose of avoiding flashovers toward the molybdenum cups of the Moly-Cup seal.

The cap is preferably fastened on parts of the lamp. This is performed either by "arresting" it loosely between a plurality of parts, or by fastening it rigidly on one part; the covering (for example a quartz glass tube) on the long supply lead, in particular, comes into consideration for this. The cap can be fused thereon by means of an adhesive glass part (for example in the form of adhesive strips), but can also be cemented or bonded thereon.

FIGURES

The invention is to be explained in more detail below with the aid of a plurality of exemplary embodiments.

In the drawing:

FIG. 1 shows a metal halide lamp, in section,

FIG. 2 shows the lamp from FIG. 1 with a base,

FIG. 3 shows the cap of the lamp from FIG. 1 in detail,

FIG. 4 shows a cross section of the cap from FIG. 3,

FIG. 5 shows a further exemplary embodiment of a metal halide lamp, in section, and FIG. 6 shows a further exemplary embodiment of a detail of the lamp.

DESCRIPTION OF THE DRAWINGS

The design of a high-pressure discharge lamp according to the invention with a base at one end is illustrated in FIGS. 1 and 2. The high-pressure discharge lamp described here in the exemplary embodiment is a metal halide lamp for photo-optical purposes with a power consumption of 6 kW.

The high-pressure discharge lamp has a discharge vessel 1 made from quartz glass, which is closed at two ends and in which an ionizable filling gas and two electrodes 2 are enclosed. The discharge vessel 1 is held by means of a bipartite frame 3, 4 in an outer bulb 5 which is filled with nitrogen (900 mbar cold filling pressure) and closed at one end. The outer bulb 5 is essentially axially symmetrical. Its end 6 near the base is connected to a ceramic base 7, which has contact pins 18, by means of a metallic sleeve 24. The lamp has a high-voltage endurance of more than 50 kV.

Figure 1:
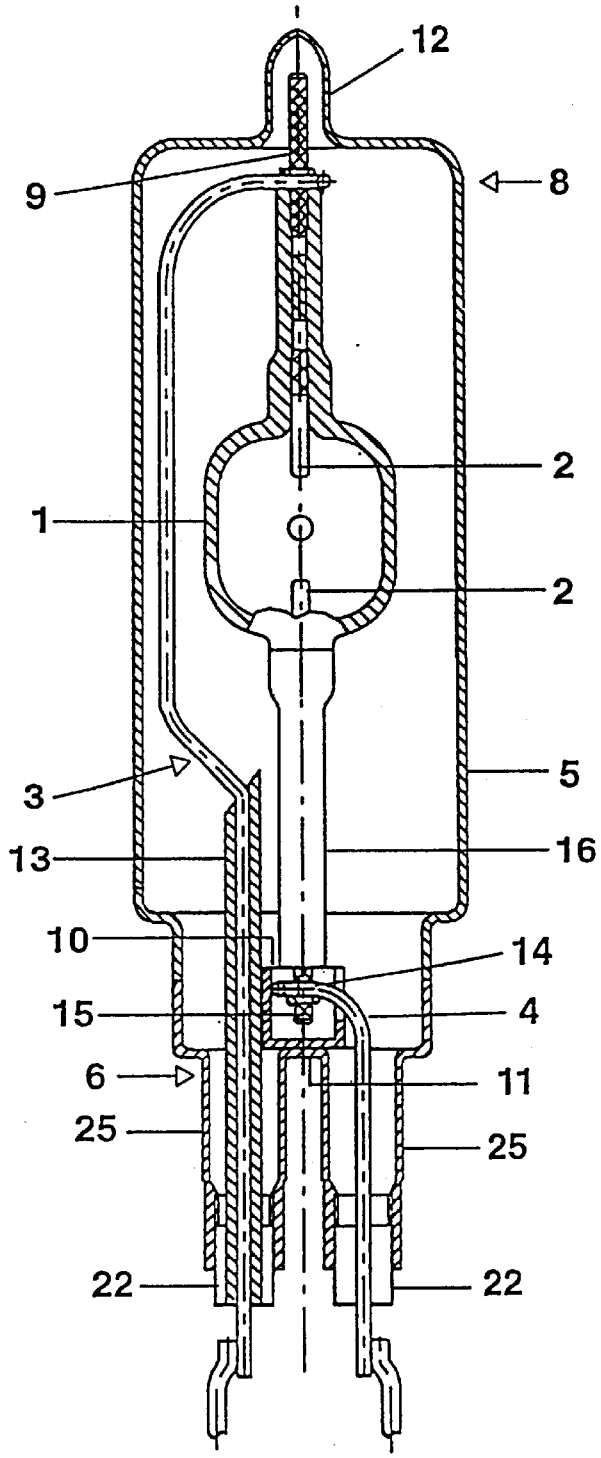

A long frame bow 3 runs along past the discharge vessel 1 to the end 8 of the outer bulb remote from the base, and is connected there to a supply lead 9 which is guided axially out of the discharge vessel. The bow has, for example, been soldered to the supply lead by means of nickel solder, or else welded to it. This supply lead 9 remote from the base is introduced into an exhaust stub 12 at the end 8 of the outer bulb remote from the base. The long bow 3 is partially covered near the base by a quartz glass tube 13 which is plugged into a tubular extension 25 at the end 6 of the outer bulb 5 near the base. It is beveled (23) at the end remote from the base such that it is extended toward the discharge vessel, as a result of which the length of the flashover path is raised.

In a similar way, a short frame bow 4, which is arranged predominantly parallel to the long bow 3, is held in a tubular extension 25 at the end of the outer bulb 6 near the base. The wire diameter D of the short bow 4 is 3 mm. The free end 14 of the bow 4 is angled away and arranged transverse to the lamp axis. It is connected, for example by soldering or welding, at a point of intersection, to the supply lead 15 guided out of the end 16 (designed as a seal or pinch) of the discharge vessel near the base. The length L of the part of the supply lead projecting from the discharge vessel is 6 mm. It therefore follows that the ratio L/D=2.

Figure 3:
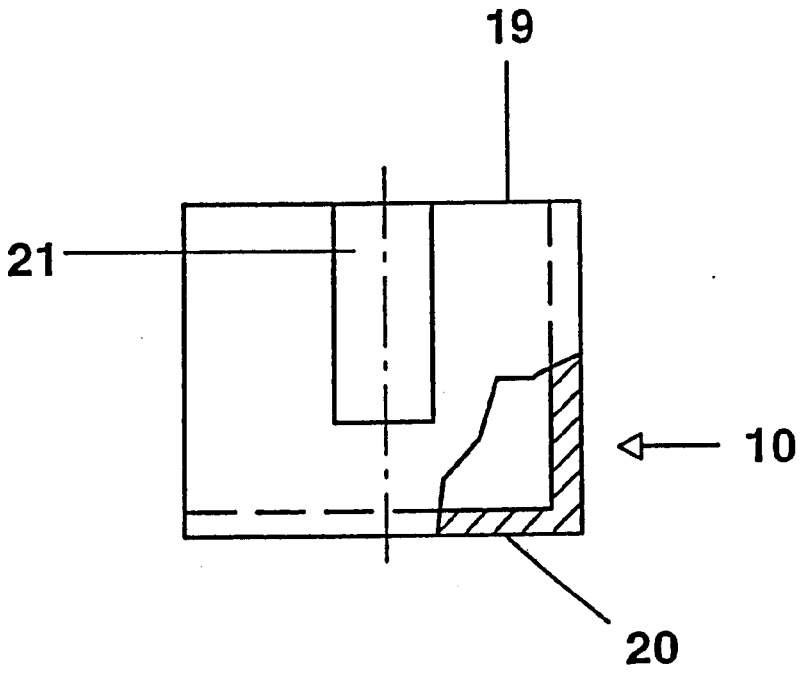
Figure 4:
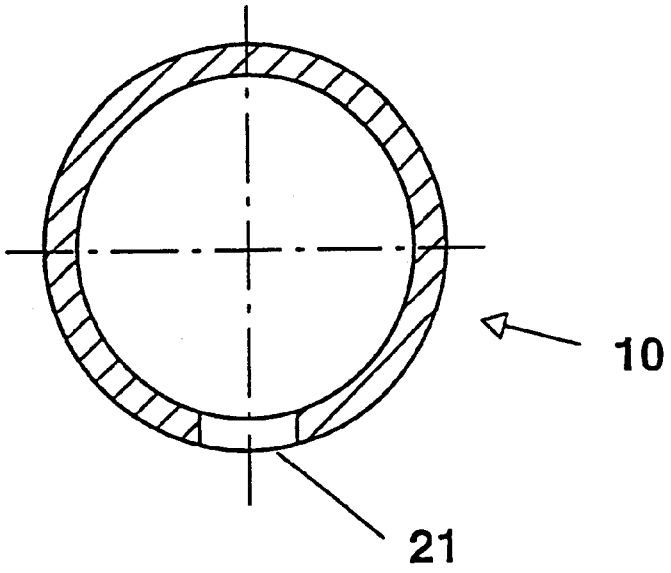

A tubular cap 10 with an open first end 19 and closed second end 20 is aligned axially in the region of the point of intersection (see FIGS. 3 and 4). It surrounds the short supply lead 15 completely at a distance, and chiefly shields off from the covering 13 the end 14 of the bow 4 situated transverse to the axis. This bow end 14 is introduced into the cap through an axially parallel slot 21 which extends from the open first end 19 of the cap over approximately two thirds of the length of the cap. Thus, the supply lead 15 and the angled-off end 14 of the supply conductor 4 are finally enclosed in the cap.

The extension tubes 25 are guided out of the bottom 11 at the end of the outer bulb. The cap 10 is seated loosely on the bottom 11 with its second end 20. Moreover, it bears loosely against the covering 13 with its side wall. On the one hand, it is therefore adequately fixed, but on the other hand has sufficient play for thermally governed expansion during operation of the lamp. Thus, overall the cap is held loosely on the short supply conductor. A particular measure for fastening the cap is not required, the effect of this being favorable in terms of time and cost and substantially facilitating the production process. The first end 19 of the cap ends approximately at the level of the end of the seal 16, formed as a solid cylinder, of the discharge vessel.

The ends of the supply conductors 3, 4 are respectively surrounded by a cup-type hollow cylinder 22 made from molybdenum (so-called Moly-Cup). At the end near the base, the bottom of the hollow cylinder 22 is connected to the supply conductor 4 or the quartz glass tube 13 of the supply conductor 3. The free end of the hollow cylinder is thin and ends in the extension tube 25. The Moly-Cup seal is a commercially available quartz glass/metal transition. This transition is vacuum tight. Further details are to be found in U.S. Pat. No. 3,804,045, for example.

The ends of the frame bows 3, 4, which respectively project further beyond the Moly-Cup 20, are respectively connected to a flexible nickel lead 17. The flexible lead 17 is guided in a central bore of the contact pin 18 as far as the end thereof and soldered there to the pin 18. Voltages of approximately 40 to 50 kV are applied during hot starting of the lamp. The starting voltage is preferably still higher in the case of higher wattages.

By comparison with a lamp of the same design without a cap, this lamp achieved a substantially more reliable hot restarting. In this case, a time window was tested between switching off and restarting, the window being between a few seconds and 7 minutes. The capless lamp did not start for between 3 and 6 minutes.

Figure 2:
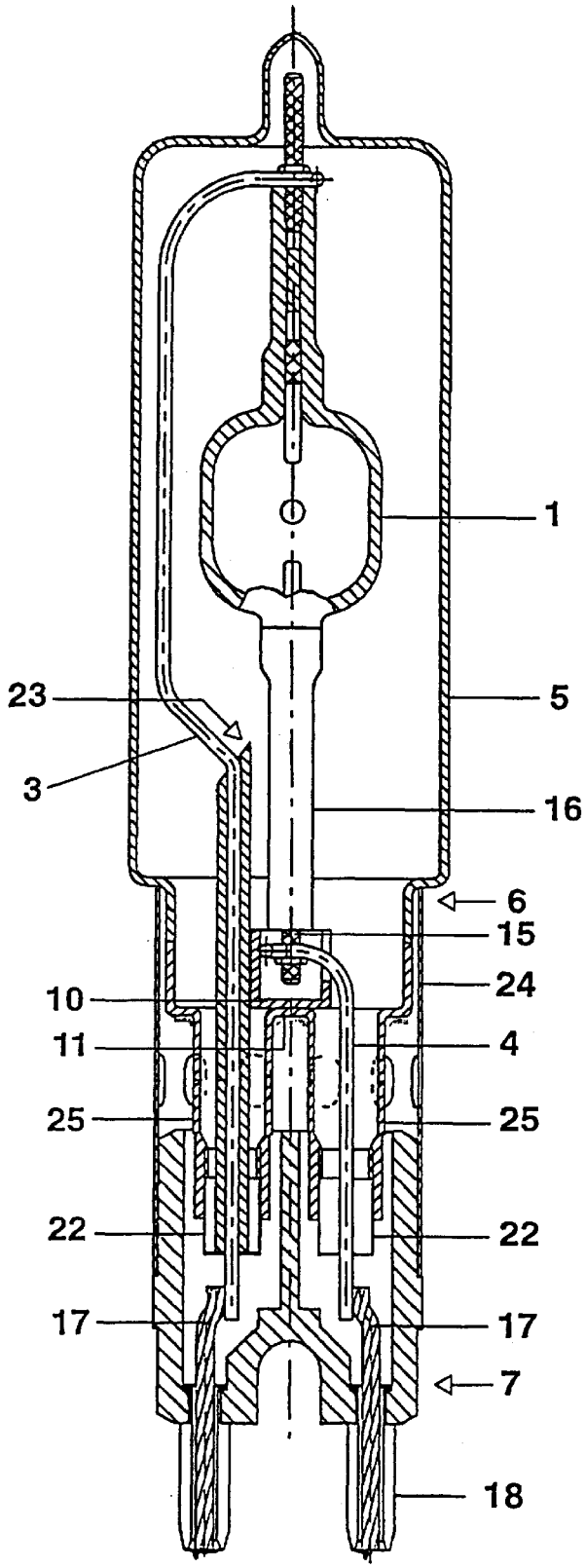
Figure 5:
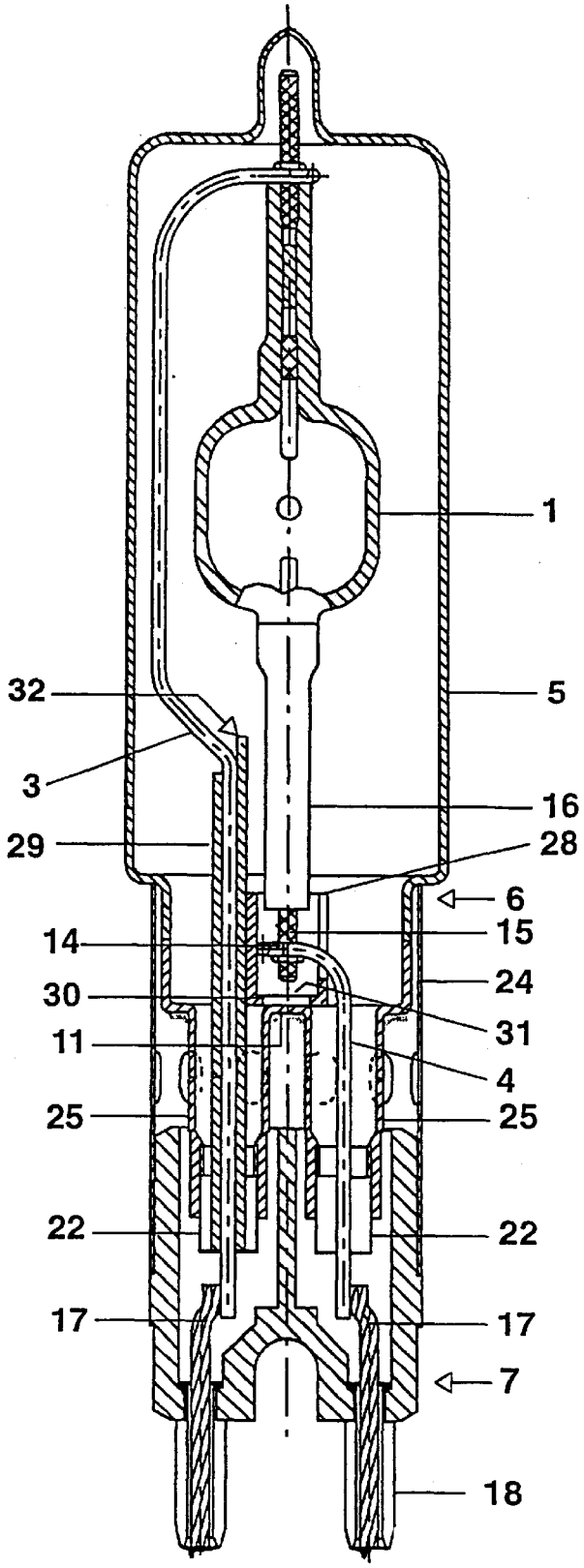

In a further exemplary embodiment in accordance with FIG. 5, identical reference numerals correspond to the same parts as in FIG. 2. However, by contrast, the free end 32 of the covering 29 of the supply conductor 3 remote from the base is designed in a stepped fashion, and this offers advantages in process engineering as compared with beveling. The cap 30 is drawn with a width of 10 mm over the sealing means 16 and surrounds it at a slight distance. As a result, not only is the creeping discharge to the supplied conductor 3 along the covering 29 suppressed, but a direct flashover between the free end 14 of the supply conductor 4 near the base and the supply conductor 3 remote from the base is rendered difficult. Not only is the first end 28 of the cap 30 open, but so also is the second end 31 which is near the base.

Figure 6A:
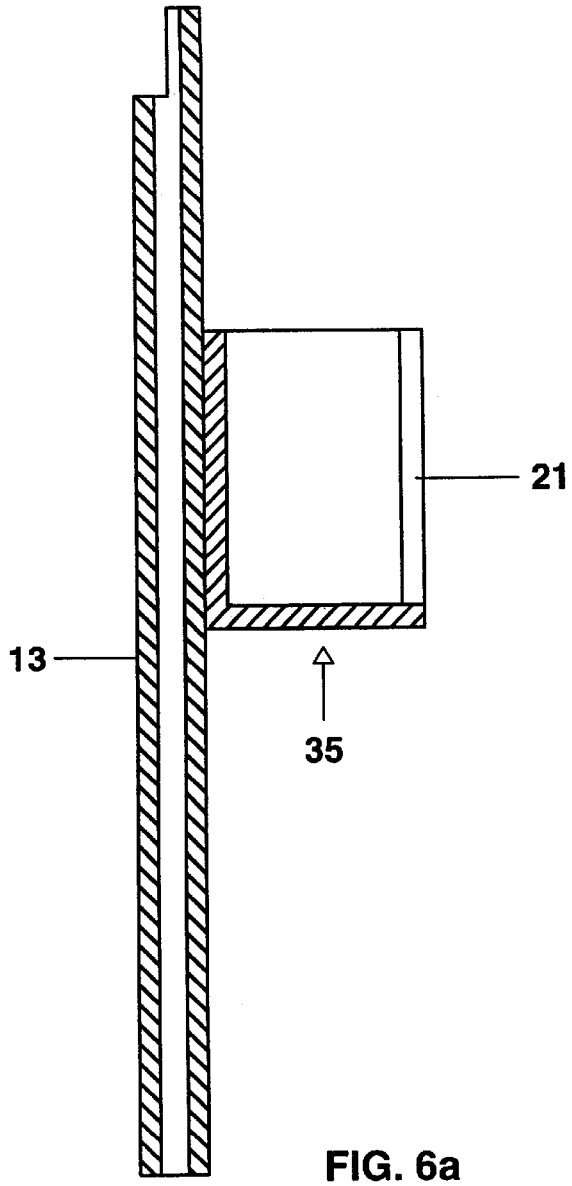
Figure 6B:
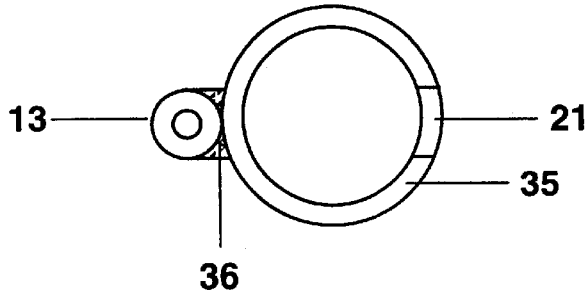

FIG. 6 shows a further exemplary embodiment in detail, in the case of which the cap 35 is fastened on the quartz glass tube 13 by being fused on there. This is performed by two adhesive strips 36 made from quartz glass, which extend along the cap 35 on the quartz glass tube 13. The adhesive glass part 36 (two adhesive strips) are well in evidence in plan view in FIG. 6*b* in the two angles between the cap and the quartz glass tube. In the side view (FIG. 6*a*), the adhesive strips are not to be seen, since the section is a centrally selected one; however, the slot 21 is well in evidence in this section.

What is claimed is:

1. A high-pressure discharge lamp comprising:

a discharge vessel (1) closed at two ends and defining a lamp axis, supply leads (9, 15) extending out from the discharge vessel and connecting in an electrically conducting fashion to a short and a long electric supply conductor (3, 4) in an outer bulb (5) closed at one end, the long supply conductor being sheathed with an insulating covering (13), at least a free end of the short supply conductor (4) belonging to the supply lead (15) near a base is covered partially by a tubular cap (10) having a first end (19) and a second end (20), the first end (19) of the cap is directed toward the discharge vessel, the second end (20) of the cap is directed toward the base and is closed, whereby the insulating covering and the cap avoid flashover.

2. The high-pressure discharge lamp as claimed in claim 1, wherein the cap is held loosely on the short supply conductor.

3. The high-pressure discharge lamp as claimed in claim 1, wherein the free end of the short supply conductor (4) near the base is angled away transverse to the lamp axis.

4. The high-pressure discharge lamp as claimed in claim 3, wherein the cap (10) is slotted on one side at the first end (19), and the free end of the short supply conductor (4) near the base is inserted in this slot (21).

5. The high-pressure discharge lamp as claimed in claim 1, wherein the insulating covering (13) on the long supply lead has a free end which is beveled (23) or stepped (32).

6. The high-pressure discharge lamp as claimed in claim 1, wherein the cap (10) is seated on a bottom (11) of an end of the outer bulb, and/or bears against a covering (13), or is fastened on a covering (13).

7. The high-pressure discharge lamp as claimed in claim 1, wherein the length of a part projecting from the discharge vessel, of the supply lead (15) near the base corresponds at most to six times the diameter of the short supply conductor (4) near the base.

8. The high-pressure discharge lamp as claimed in claim 1, wherein the discharge vessel is closed by means of two sealing parts consisting of seals or pinches, the cap reaching at least up to the sealing part (16) near the base.

9. The high-pressure discharge lamp as claimed in claim 8, wherein the cap surrounds the sealing part near the base at least over an axial length of 5 mm.

10. The high-pressure discharge lamp as claimed in claim 1, wherein the length of a part projecting from the discharge vessel, of the supply lead (15) near the base corresponds at most three times the diameter of the short supply conductor (4) near the base.

* * * * *